United States Patent [19]

Rochlitz et al.

[11] 4,072,520

[45] Feb. 7, 1978

[54] ELECTROPHOTOGRAPHIC DUAL LAYER RECORDING MATERIAL

[75] Inventors: Jürgen Rochlitz, Breckenheim; Gunter Schön, Wiesbaden, both of Germany

[73] Assignee: Hoechst Aktiengesellschaft, Germany

[21] Appl. No.: 354,320

[22] Filed: Apr. 25, 1973

[30] Foreign Application Priority Data

Aug. 30, 1972 Germany ..... 2242595

[51] Int. Cl.[2] ..... G03Q 5/06

[52] U.S. Cl. ..... 96/1.5 R; 96/1.6

[58] Field of Search ..... 96/1 R, 1 PE, 1.3, 1.5, 96/1.6; 252/501

[56] References Cited

U.S. PATENT DOCUMENTS

| | | | |
|---|---|---|---|
| 3,287,123 | 11/1966 | Hoegl | 96/1.5 |
| 3,384,488 | 5/1968 | Tulagins et al. | 96/1.3 |
| 3,489,558 | 1/1970 | Clecak et al. | 96/1.5 X |
| 3,549,358 | 12/1970 | Clecak et al. | 96/1.5 X |
| 3,598,582 | 8/1971 | Herrick et al. | 96/1.5 |
| 3,634,079 | 1/1972 | Champ et al. | 96/1.6 X |
| 3,725,058 | 4/1973 | Hayashi et al. | 96/1.5 |

FOREIGN PATENT DOCUMENTS

| | | | |
|---|---|---|---|
| 763,540 | 8/1971 | Belgium | 96/1.5 |
| 119,409 | 3/1962 | Czechoslovakia | 96/1.5 |
| 4,326,710 | 11/1968 | Japan | 96/1.5 |
| 836,151 | 6/1960 | United Kingdom | 96/1.5 |

OTHER PUBLICATIONS

Chadwell et al., "Photoconductor," IBM Tech. Discl. Bull., vol. 14, No. 9, Feb. 1972, p. 2781.

Derwent Abstracts of Belgium Patents 763,389; 763,390; 763,391; 763,541, pp. 569665 & 614045.

*Primary Examiner*—Roland E. Martin, Jr.

*Attorney, Agent, or Firm*—James E. Bryan

[57] ABSTRACT

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound.

6 Claims, 29 Drawing Figures

Figure 1:
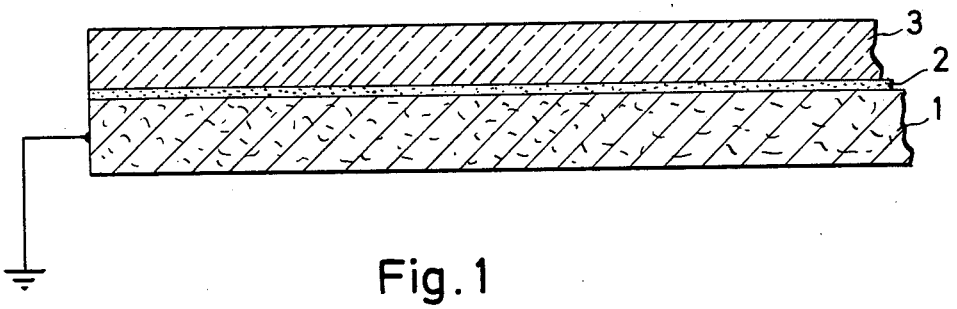

FORMULAE
I
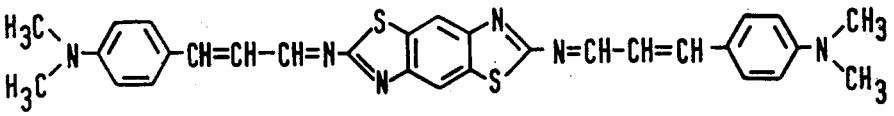
II
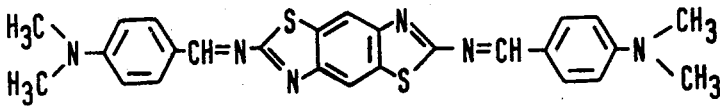
III
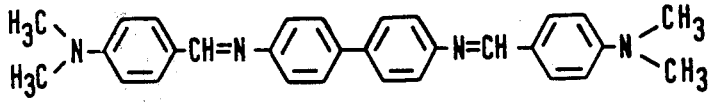
IV
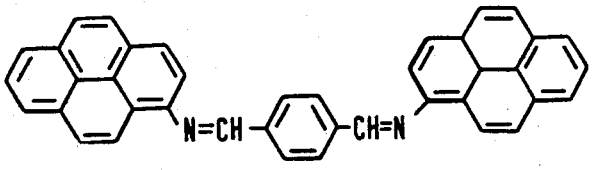

FORMULAE
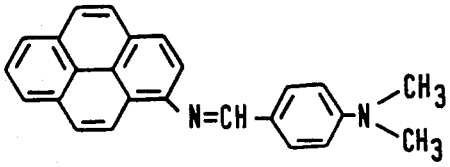
V
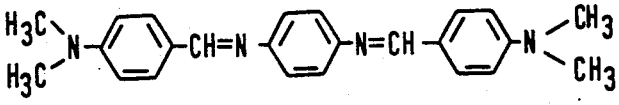
VI
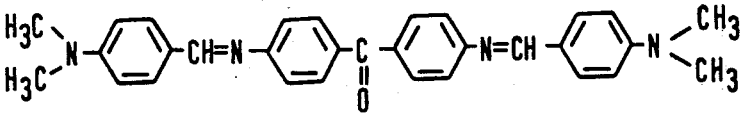
VII
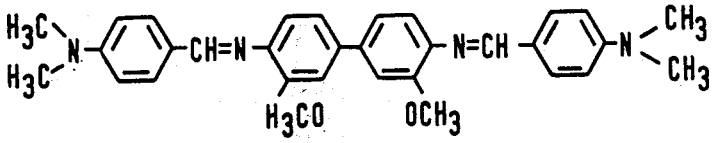
VIII
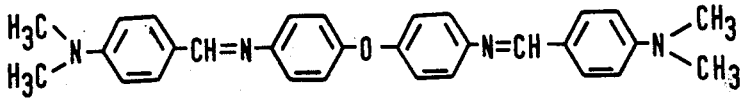
IX
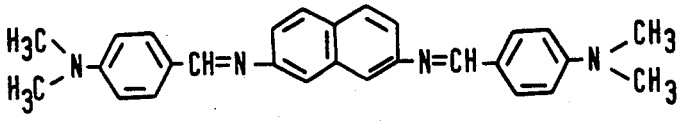
X FORMULAE
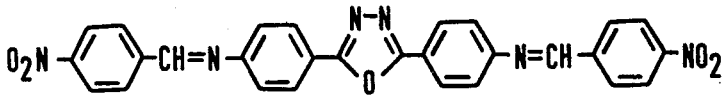
XI
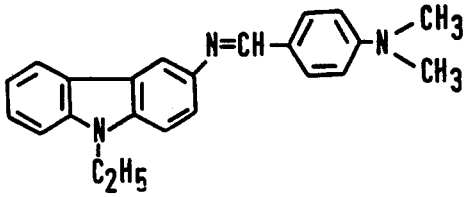
XII
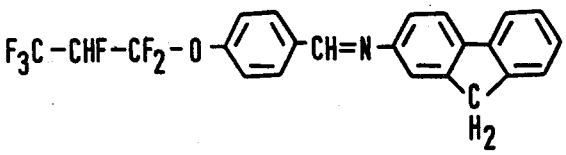
XIII
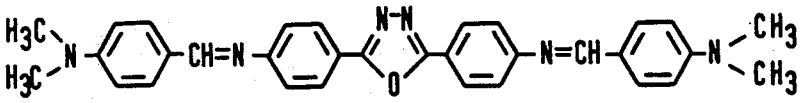
XIV
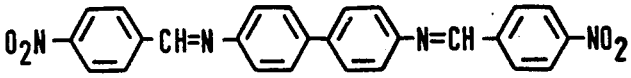
XV
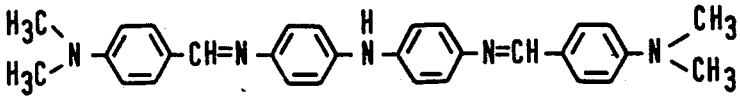
XVI
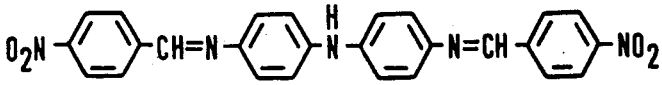
XVII FORMULAE
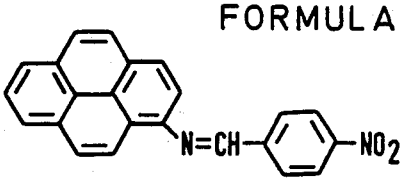
XVIII
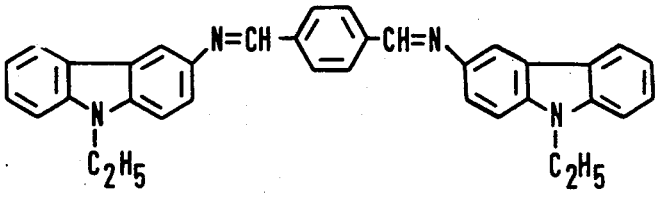
XIX
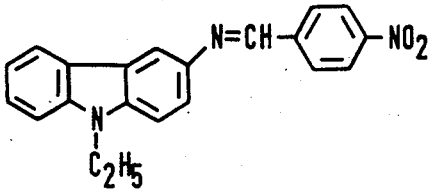
XX
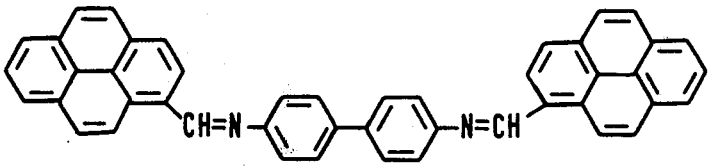
XXI
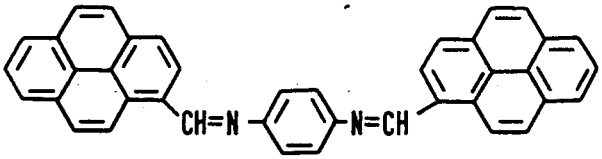
XXII
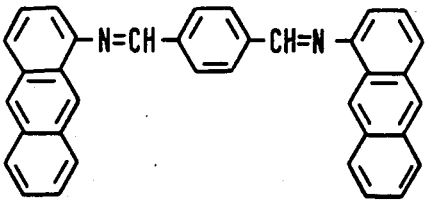
XXIII FORMULAE
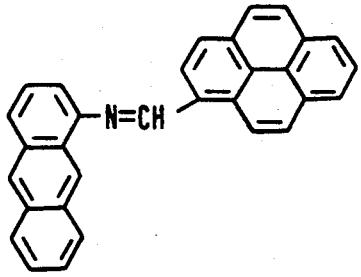
XXIV
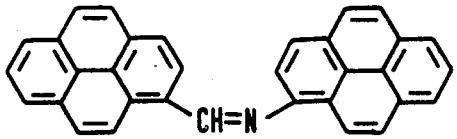
XXV
XXVI
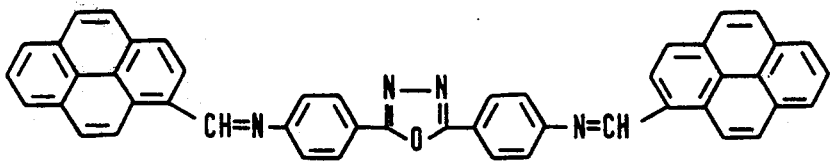

ELECTROPHOTOGRAPHIC DUAL LAYER RECORDING MATERIAL

This invention relates to an electrophotographic recording material consisting of an electroconductive support material and a photoconductive double layer of organic materials which consists of a homogeneous, opaque, charge carrier producing dyestuff layer and of a transparent top layer of insulating materials with at least one charge transporting compound.

It is known from German Offenlegungsschriften Nos. 1,597,877 and 1,797,342 for electrophotographic recording material to extend the spectral sensitivity of selenium layers to the red spectral range by a double layer arrangement, e.g. with phthalocyanine dispersion layers. Disadvantageous are the vacuum vapour depositions of selenium requiring high technical expenditure, the brittleness of comparatively thick selenium layers, the poor adhesion of adjacent heterogeneous constituents in these layers and the only difficultly realizable uniformly wetting coating with the corresponding dispersions. Furthermore, no optimum light-sensitivities can be achieved as a result of the absorption behaviour and the different charge conducting mechanisms of selenium and phthalocyanine in the double layer arrangement.

From U.S. Pat. No. 3,573,906, for example, there are also known photoconductive double layers containing an organic, possibly photoconductive, insulating layer between the support material and the vapor-deposited selenium layer in order to impart adhesion. Such a layer construction, however, considerably hinders the necessary charge transport so that, in this case too, no higher light-sensitivities are obtainable.

Furthermore, from German Auslegeschrift No. 1,964,817, it is known to provide vapor-deposited selenium layers with a layer of an organic, photoconductive insulating material which is substantially insensitive to light in the visible range of the spectrum. According to German Offenlegungsschrift No. 2,120,912, it has also been suggested to use those light-sensitive layer arrangements for electrophotographic recording materials which contain, as the charge carrier producing layer, an inorganic material, such as the sulfide, selenide, sulfoselenide or telluride of cadmium or zinc, and as the charge carrier transporting layer, an organic material with at least 20 percent by weight of 2,4,7-trinitro-9-fluorenone. A disadvantage of the production of these layers with inorganic photoconductors is the exact observation of the vapor deposition conditions of selenium or the exact adjustment of the mixtures in order to obtain a good photoconductive modification of the inorganic material, such as to aluminum, is insufficient. Fatigue in repeated charge/exposure cycles does not allow the use in electrophotographic copying devices. Japanese Pat. application No. 43-26710 already discloses photoconductive double layers of organic materials on a conductive support. According to that application, a lower, relatively thick layer of a considerably diluted homogeneous solution of a sensitizer in a binder is provided with an upper transparent light-sensitive layer. This layer construction, however, only offers a relatively low sensitivity increase only little meeting technical demands. Another known suggestion according to German Offenlegungsschrift No. 1,909,742 is to repeatedly pour a sensitizer solution over a photoconductive layer and to evaporate the solvent. A disadvantage thereof is the low mechanical resistance of the applied layer as a result of insufficient cohesion and adhesion of the applied sensitizer. Furthermore, repeated coating is cumbersome.

The construction of photoconductive double layers containing a dyestuff layer is also known, e.g. from Belgian Pat. Nos. 763,389 and 763,541, but for this layer construction, top layers are used which allow no sensitivities satisfying highest demands and, as regards adhesion between the dyestuff layer and the top layer, do not represent an optimization and are not sufficiently resistant to mechanical attack, e.g. in electrophotographic copying devices, particularly to that due to the cleaning of the photoconductive layer.

Furthermore, various azomethines also have been suggested as photoconductive substances (German Pat. Nos. 1,216,688 and 1,060,712). As has been shown, these materials are not highly sensitive since 5 to 50 seconds are necessary for their full exposure to light. German Offenlegungsschrift No. 1,963,197 discloses another application form of azomethines. But in this case, too, the light sensitivies achieved are not high enough to use the materials in an episcopically working copying device. The materials rather have to be exposed by the contact procedure. Furthermore, prior to the application of a top layer, the microcrystals of the described azomethines in powder form must be mechanically oriented for the utilization of the reflex copying effect and for the increase of the sensitivity. Maximum effects thus can only be achieved with the use of polarized light and in contact with the original.

It is the object of the present invention to provide an organic photoconductor layer highly light-sensitive for the xerographic copying procedure which overcomes the described disadvantages and the adhesion of which between the various layers satisfies the highest technical demands, which exhibits no wear or fatigue and which, even after repeated use, may be used again rapidly.

The present invention provides an electrophotographic recording material consisting of an electroconductive support material with a photoconductive double layer of organic materials which consists of a homogeneous, opaque, charge carrier producing dyestuff layer and of a transparent top layer of insulating materials with at least one charge transporting compound and is characterized in that the organic dyestuff layer consists of a compound of the general formula $$R_1—CH=N(—A—N=CH)_n—R_2$$

or $$R_1—N=CH—A—CH=N—R_2$$

in which $R_1$ and $R_2$ are identical or different and stand for an optionally substituted aromatic or heterocyclic radical, $n$ is 0 or 1, and A is an optionally substituted aromatic and/or heterocyclic ring system which, in the case of more than one ring, may be condensed or non-condensed, ether, imino or carbonyl groups also optionally serving as ring members in the non-condensed case, and in that the transparent top layer consists of a mixture of a charge transporting, heterocyclic compound having an extended $\pi$-electron system or of a condensation product from 3-bromopyrene and formaldehyde and of a binder.

By means of the invention, it is possible to obtain highly light-sensitive, photoconductive double layers for the electrophotographic recording material of the invention which have a high mechanical resistance and may be arranged on a cylindrical drum, for example, or may circulate as an endless belt without exhibiting special signs of wear and thus are very suitable for the use in electrophotographic copying devices. The high light-sensitivity particularly results from the fact that the charge transporting compound present in the transparent top layer is sensitized by the charge carrier producing dyestuff layer in that the charge carriers, such as electrons or holes are taken by the top layer.

In a preferred embodiment, the organic dyestuff layer has a thickness in the range from about 0.005 to about 2 μm, preferably from about 0.01 to about 2 μm. High concentration of excited dyestuff molecules is achieved thereby in the dyestuff layer and at the boundary surface between the dyestuff layer and the top layer. Furthermore, the adhesion between the electroconductive support material and the top layer is not impaired.

In a preferred embodiment, the transparent top layer has a thickness in the range from about 5 to about 20 μm. This assures a sufficiently high charge.

Figure 2:
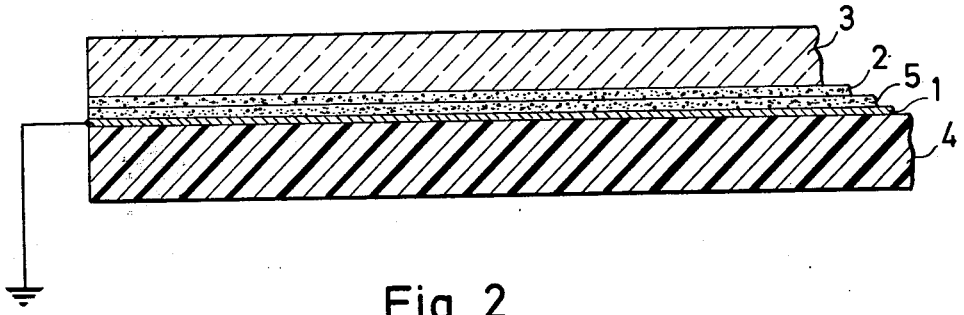

The assembly of the electrophotographic recording material can be seen in the attached FIGS. 1 and 2.

FIG. 1 shows a material which consists of an electroconductive layer support 1, the organic dyestuff layer 2, and the organic transparent top layer 3.

FIG. 2 shows a metallized plastic layer 1, 4 as the layer support to which an intermediate layer 5 inhibiting charge carrier injection in the dark is applied, and the photoconductive double layer from organic dyestuff layer 2 and organic, transparent top layer 3 on this intermediate layer.

Figure 3:
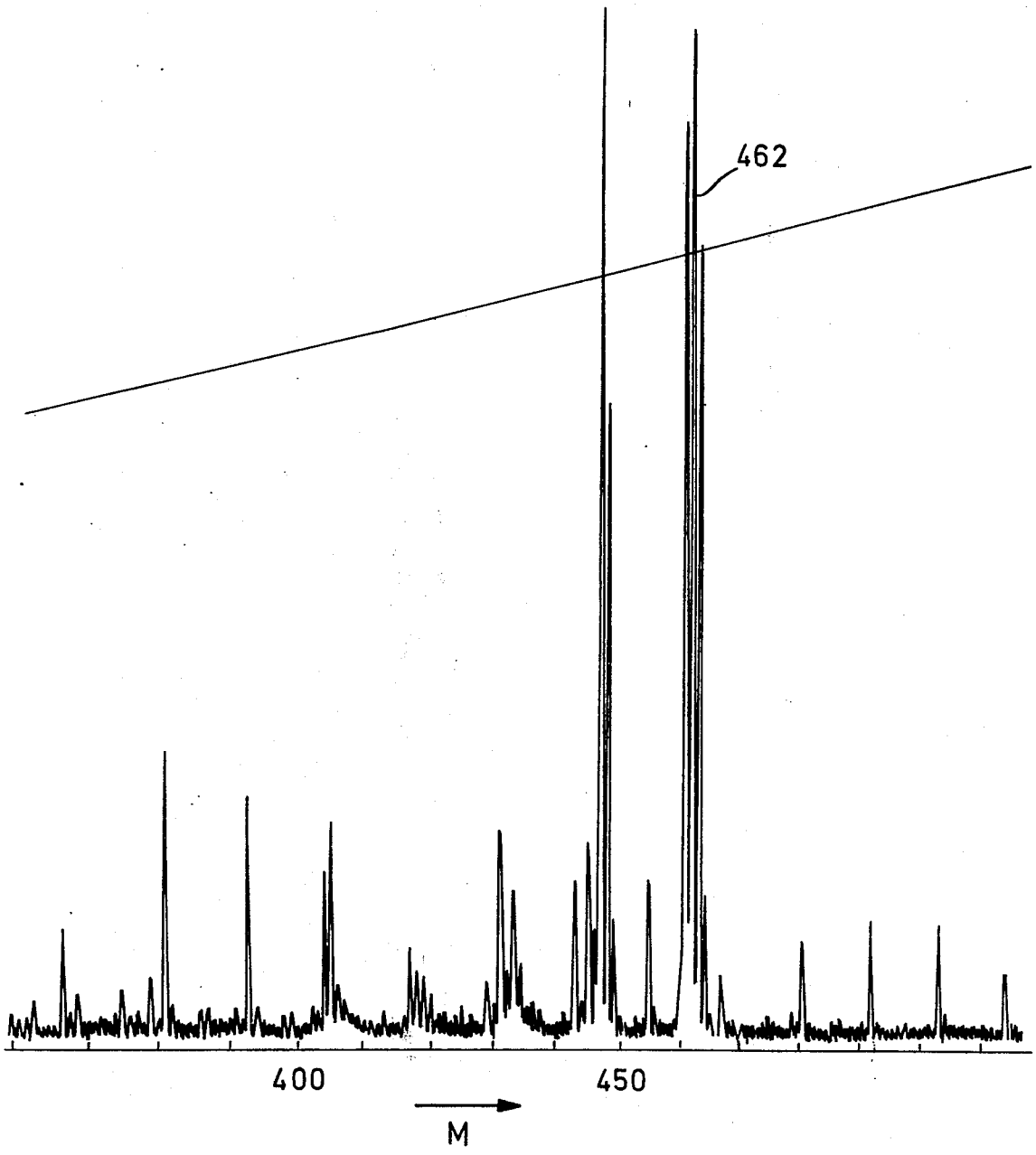

FIG. 3 shows the mass spectrum of compound IX.

Suitable electroconductive support materials are materials which hitherto have been used for this purpose, for example aluminum foils or transparent plastic supports to which aluminum, gold copper, zinc, cadmium, indium, antimony, bismuth, tin, lead or nickel has been laminated or applied by vapor deposition.

The intermediate layer shown in FIG. 2 consists of organic material, e.g. polyamide resin, or of a thermally, anodically or chemically produced metal oxide layer, e.g. an aluminum oxide layer.

The organic dyestuff layer of the recording material of the invention substantially determines the spectral light-sensitivity of the photoconductive double layer of the invention.

According to the stated general formulae in which the aromatic or heterocyclic radical may be groupings such as phenyl, styryl, carbazyl, anthryl, pyrenyl, fluorenyl, and possible substituents may be alkyl or alkoxy with 1 to 4 carbon atoms, amino, alkyl amino or dialkyl amino, cyano or nitro groups, halogen or also halogen-substituted alkyl or alkoxyl and in which the aromatic and/or heterocyclic ring system may be groupings such as benzene, diphenyl, naphthalene, pyrane, perylene, diphenyl ether, diphenyl amine, benzophenone, oxazole, imidazole, pyrazole, thiazole, oxadiazole, bis-phenyl-oxadiazole, benz-bis-thiazole, carbazole, xanthene, which may be substituted by alkyl or alkoxy groups with 1 to 4 carbon atoms, the attached table of formulae lists the following suitable dyestuffs, for example:

| Formula No. | Description | Melting point (° C) |
|---|---|---|
| I | Bis-(p-dimethylamino-cinnamylidene)-2,6-diamino-benzbisthiazole-1,3,5,7 | 295 |
| II | Bis-(p-dimethylamino-benzylidene)-2,6-diamino-benzbisthiazole-1,3,5,7 | 356 |
| III | Bis-(p-dimethylamino-benzylidene)-4,4'-diamino-diphenyl | 311 |
| IV | Bis-(3-pyrenyl-amino)-terephthylidene | 324 |
| V | Dimethylamino-benzylidene-3-amino-pyrene | 177 |
| VI | Bis-(p-dimethylamino-benzylidene)-p-phenylenediamine | 289 |
| VII | Bis(-p-dimethylamino-benzylidene)-4-,4'-diaminobenzophenone | 241 |
| VIII | Bis-(p-dimethylamino-benzylidene)-4,4'-diamino-3,3'-dimethoxy-diphenyl | 251 |
| IX | Bis-(p-dimethylamino-benzylidene)-4,4'-diamino-diphenyl-ether | 228 |
| X | Bis-(p-dimethylamino-benzylidene)-2,7-diamino-naphthalene | 255 |
| XI | Bis-(p-nitro-benzylidene-p-aminophenyl)-2,5-oxadiazole-1,3,4 | 280 |
| XII | p-Dimethylamino-benzylidene-3-amino-N-ethylcarbazole | 132 |
| XIII | p-(α-Difluoro-β-fluoro-γ-trifluoro-n-propoxy)-benzylidene-2-amino-fluorene | 220 |
| XIV | Bis-(p-dimethylamino-benzylidene-p-amino-phenyl)2,5-oxadiazole-1,3,4 | 272 |
| XV | Bis-(p-nitro-benzylidene)-4,4'-diamino-diphenyl | 247 |
| XVI | Bis-(p-dimethylamino-benzylidene)-4,4'-diamino-diphenylamine | 222 |
| XVII | Bis-(p-nitro-benzylidene)-4,4'-diamino-diphenylamine | 220 |
| XVIII | p-Nitro-benzylidene-3-aminopyrene | 199 |
| XIX | Bis-(N-ethyl-carbazyl-amino)-terephthylidene | 232 |
| XX | p-Nitro-benzylidene-3-amino-N-ethyl-carbazole | 165 |
| XXI | Bis-(3-pyrenal)-4,4'-diamino-diphenyl | 335 |
| XXII | Bis-(3-pyrenal)-p-phenylene-diamine | 314 |
| XXIII | Bis-(1-anthryl-amino)-terephthylidene | 383 |
| XXIV | 3-Pyrenal-1-amino-anthracene | 231 |
| XXV | 3-Pyrenal-3-amino-pyrene | 288 |
| XXVI | Bis-(3-pyrenal-p-aminophenyl-)2,5-oxadiazole-1,3,4 | 309 |

According to the invention, compounds of the formulae I, II, IV, IX, XI and XXIII have proved very particularly successful.

The compounds are known and can be manufactured easily, analogously to the manufacture of Schiff's bases, from the corresponding aromatic aldehyde and the corresponding primary amine. This is described in more detail in relation to the compound of the formula IX:

10 g of 4,4'-diaminodiphenyl-ether and 16.4 g of dimethylamino-benzaldehyde are separately each dissolved in 100 ml of dimethylformamide and subsequently brought together. 100 mg of toluenesulphonic acid are added as the catalyst. After boiling under reflux for about 3 hours, 102 g of the azo-methine (melting point 218°–219° C) are obtained. After one recrystallisation from dimethylformamide, a melting point of 227°–228° C results.

As regards the preparation of the other compounds, a recrystallisation is in many cases superfluous since the compounds obtained prove to be chromatographically a single substance. For analytical control, mass spectra were produced, which gave all theoretical values. As an example, attention is drawn to the appended mass spectrum of the compound IX in FIG. 3.

The organic dyestuff layer must be extremely uniform since only its uniformity guarantees uniform injection of charge carriers into the top layer.

To achieve this object, the dyestuff layers are applied according to special coating methods. Such methods are the application by mechanically rubbing the most finely powdered dyestuff material into the electroconductive support material, the application by chemical deposition of a leucobase to be oxidized, for example, the application by electrolytical or electrochemical processes or the gun spray method. The application preferably is performed, however, by vapor depositing the dyestuff in the vacuum. A tightly packed coating is achieved thereby.

The tightly packed coating makes it unnecessary to produce thick dyestuff layers for achieving a high absorption. The tightly packed dyestuff molecules and the extremely low layer thickness permit, in a particularly advantageous manner, the transport of charge carriers so that it is completely sufficient to produce the charge carriers at the boundary layer only.

The application of the dyestuff layer by vapor deposition in the vacuum requires dyestuffs with thermal resistivity in the temperature range to be applied for vapor deposition. The high extinction of the dyestuff allows high concentration of excited dyestuff molecules. Excitation (1) and charge separation (2) take place in the dyestuff layer according to the following reaction equations:

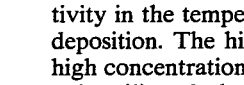

1. $S + h\nu \rightarrow S^x$

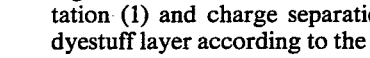

2. $S^x + S \rightarrow \cdot S^+ + \cdot S^-$ with S — dyestuff molecule
$S^x$ — excited dyestuff molecule, and
$\cdot S^+$, $\cdot S^-$ — dyestuff radical ions At the boundary surface between the organic dyestuff layer and the transparent top layer, reactions of the excited dyestuff molecules or the resulting charge carriers in the form of the dyestuff radical ions with the molecules of the charge transport effecting compound in the top layer are possible according to the following equations:

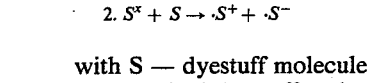

3. $S^x + F_1 \rightarrow \cdot S^- + \cdot F_1^+$

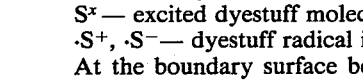

4. $S^x + F_2 \rightarrow \cdot S^+ + \cdot F_2^-$

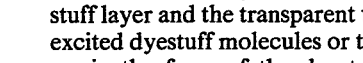

5. $\cdot S^+ + F_1 \rightarrow S + \cdot F_1^+$

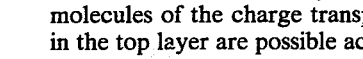

6. $\cdot S^- + F_2 \rightarrow S + \cdot F_2^-$ with
$F_1$ — donor molecule
$F_2$ — acceptor molecule
$\cdot F_1^+, \cdot F_2^-$ — donor or acceptor radical ion At the boundary surface, sensitizing reactions take place between the transparent top layer and the organic dyestuff layer. The top layer thus is a sensitized organic photoconductor at least in the area of the boundary surface, which leads to the surprisingly high photoconductivity.

Reactions 3 and 5 proceed preferably when the $\pi$-electron system in the top layer is a compound which, as a donor compound, easily can release electrons. This is the case with 2,5-bis-(4-diethylaminophenyl)-oxdiazole-1,3,4, for example. But also heterocyclic compounds with only one dialkyl amino group are suitable for rapid procedure of reactions 3 and 5. Reactions 4 and 6 are preferably possible with a substance in the top layer which, as an electron acceptor, easily accepts electrons, e.g. 2,4,7-trinitrofluorenone or 3,6-dinitro-N-t-butyl-naphthalimide.

By means of the specific embodiment of the invention it is sufficient for the efficiency of the dyestuff when, besides its intense absorption, it only has either electron-attracting substituents, e.g. $> C = O$, $—NO_2$, halogen or electron-repelling substituents, e.g. $—NH_2$, —N-alkyl$_2$ or —O-alkyl, depending on whether it is preferably suitable for reactions 3, 5 or 4, 6. The invention permits charge carrier transport fostered by a particularly low expenditure of energy within the tightly packed dyestuff layer according to the following reactions:

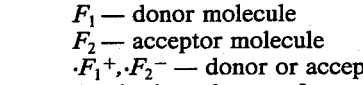

7. $\cdot S^+ + S \rightarrow S + \cdot S^+$ or

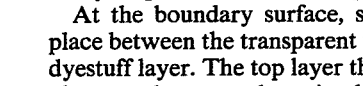

8. $S + \cdot S^- \rightarrow \cdot S^- + S$

In all conventional sensitizing processes, however, transport via the dyestuff molecules present in low concentration in impeded by their large distance from one another.

Analogous is the charge transport in the top layer with:

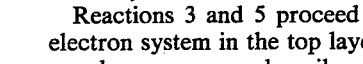

9. $\cdot F_1^+ + F_1 \rightarrow F_1 + \cdot F_1^+$ (p-conductive)

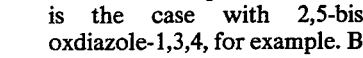

10. $\cdot F_2^- + F_2 \rightarrow F_2 + \cdot F_2^-$ (n-conductive)

The practical consequence of reactions 1 to 10 is that, in the use of electron donors in the top layer, the double layer arrangement is negatively charged so that reactions 3, 5, 8, 9 can proceed. In the inverse case, layers with electron acceptors in the top layer are positively charged so that reactions 4, 6, 7 and 10 can proceed.

As mentioned before, the dyestuff layers are only very thin and the dyestuff thus is required in a small quantity only. But vapor deposition in the high vacuum assures an extremely high uniformity of the dyestuff layer, as it cannot easily be achieved according to a conventional coating method. This uniformity considerably contributes to the high sensitivity distinguishing the layers of the invention, the charge carrier reactions 3 to 6 proceeding without disturbing each other (recombination).

The transparent top layer has a high electric resistance and prevents in the dark the flowing off of the electrostatic charge. Upon exposure to light, it transports the charges produced in the organic dyestuff layer.

In the case of negative charge, the transparent top layer preferably consists of a mixture of an electron donor compound and a binder. But when the electrophotographic recording material is to be used for positive charge the transparent top layer consists of a mixture of an electron acceptor compound and a binder.

Consequently, in the transparent top layer there are used compounds for charge transport which are known as electron donors or electron acceptors. They are used together with binders or adhesives adapted to the compound for charge transport as regards charge transport, film property, adhesion, and surface characteristics. Furthermore, conventional sensitizers or substances forming charge transfer complexes are preferably additionally present. But they can only be used in so far as the necessary transparency of the top layer is not impaired. Finally, other usual additives such as levelling agents, plasticizers, and adhesives may also be present.

Suitable compounds for charge transport are especially those organic compounds which have an extended $\pi$-electron system, e.g. monomer aromatic heterocyclic compounds.

Monomers employed in accordance with the invention are those which have at least one substituted amino group or two alkoxy groups. Particularly proved have heterocyclic compounds, such as oxdiazole derivatives, which are mentioned in German Pat. No. 1,058,836. An example thereof is in particular the 2,5-bis-(p-diethylaminophenyl)-oxdiazole-1,3,4. Further suitable monomer electron donor compounds are, for example, triphenyl amine derivatives, benzo-condensed heterocycles, pyrazoline or imidazole derivatives, as well as triazole and oxazole derivatives, as disclosed in German Pat. Nos. 1,060,260 and 1,120,875, and carbocyclic compounds.

Also suitable are formaldehyde condensation products with various aromates, e.g. condensates from formaldehyde and 3-bromopyrene.

Besides these mentioned compounds having predominantly a p-conductive character, it is also possible to use n-conductive compounds. These so-called electron acceptors are known from German Pat. No. 1,127,218, for example. Compounds such as 2,4,7-trinitrofluorenone or N-t-butyl-3,6- dinitro-naphthalimide have proved particularly suitable.

Suitable binders with regard to flexibility, film properties, and adhesion are natural and synthetic resins. Examples thereof are in particular polyester resins, e.g. those marketed under the names Dynapol(R) (Dynamit Nobel), Vitel(R) (Goodyear), and which are copolyesters of iso- and terephthalic acid with glycol. Silicone resins as those known under the name SR of General Electric Comp., USA, of Dow 804 of Dow Corning Corp., USA, and representing three-dimensionally cross-linked phenyl-methyl siloxanes have proved particularly suitable. Furthermore, copolymers of styrene and maleic acid anhydride, e.g. those known under the name Lytron(R), Monsanto Chemical Comp., USA, but also polycarbonate resins, e.g. those known under the name Lexan Grade(R) of General Electric Comp., USA, or after-chlorinated polyvinyl chlorides such as Rhenoflex(R) of Rheinpreussen AG, Germany, or chlorinated polypropylene such as Hostaflex(R) of Farbwerke Hoechst AG, Germany, are suitable for use.

The mixing ratio of charge transporting compound to binder may vary. Relatively certain limits are given, however, by the requirement for maximum photosensitivity, i.e. for the biggest possible portion of charge transporting compound, and for crystallization to be prevented, i.e. for the biggest possible portion of binder. A mixing ratio of about 1:1 parts by weight has proven preferable, but mixing ratios from about 3:1 to 1:4 or above, depending on the particular case, are also suitable.

The conventional sensitizers to be used additionally may advantageously foster charge transport. Moreover, they may produce charge carriers in the transparent top layers. Suitable sensitizers are, for example, Rhodamine B extra, Schultz, Farbstofftabellen (dyestuff tables) 1st volume, 7th edition, 1931, No. 864, page 365, Brilliant Green, No. 760, page 314, Crystal Violet, No. 785, page 329, Victoria Pure Blue, No. 822, page 347, and Cryptocyanine, No 927, page 397. In the same sense as act the sensitizers may also act added compounds which form charge transfer complexes with the charge transporting compound. Thus, it is possible to achieve another increase of the photosensitivity of the described double layers. The quantity of added sensitizer or of the compound forming the charge transfer complex is so determined that the resulting donor acceptor complex with its charge transfer band still is sufficiently transparent for light absorbed by the organic dyestuff layer beneath. Examples of such electron acceptors are 3,5-or 3,4-dinitro-benzoic acid, tetrachlorophthalic acid anhydride, 2,4,7-trinitrofluorenone, 3,6-dinitronaphthalic acid anhydride, and N-substituted imides of the 3,6-dinitronaphthalic acid. Optimum concentration is at a molar donor/acceptor ratio of about 10:1 to about 100:1 and vice versa.

The addition of adhesives as binders to the charge transporting compounds already yields a good photosensitivity. In this case, low-molecular polyester resin, such as Adhesive 49 000, Du Pont, has proved particularly suitable.

In the described manner, the top layers have the property to render possible a high charge with a small dark discharge. Whereas in all conventional sensitizations an increase of the photosensitivity is connected with an increase of the dark current, the arrangement of the invention can prevent this parallelity. The layers are thus usable in electrophotographic copying devices with low copying speeds and very small lamp energies as well as in those with high copying speeds and correspondingly high lamp energies.

The invention will be further illustrated by way of the following examples, the values of which are summarized in the Table.

To manufacture photoconductive double layers, the dyestuffs listed below are vapor deposited by a vacuum pump (type A 1 of Pfeiffer, Wetzlar, Germany) at $2\text{–}4 \times 10^{-4}$ mm Hg at the indicated temperatures, which were measured immediately at the substance to be evaporated, and over the indicated period of time onto a 90 μum thick aluminum foil mounted at a distance of approximately 15 cm. In Examples 9, 10, 11, 12, metal supports from cadmium, antimony, tin, and lead were used.

In order to determine the layer thickness, dyestuff II was vapor deposited onto a 75 μum thick, transparent polyester film and onto an identical film with a vapor deposited aluminum layer (2.5 min., temperature of evaporation 320° C). A layer is obtained thereby which has an extinction of 1.71 at 650 nm on the polyester layer. From $$d = 10 \cdot \frac{E}{\epsilon} \cdot M \cdot \rho^{-1}$$

($d$ = layer thickness, E = extinction, $\epsilon$ = extinction coefficient, M = molecular weight, $\rho$ = density) a layer thickness of 0.8 μum can be calculated, if an extinction coefficient of $\epsilon \approx 1.0 \times 10^4$ and a density $\rho \approx 1$ g/cm$^3$ are assumed.

In order to test the electrophotographic properties, transparent covering layers of approximately 5–6 μum thickness are applied to the dyestuff layer. For this purpose, 1 part by weight of 2,4,7-trinitrofluorenone and one part by weight of polyester resin, for example Dynapol L 206 of Dynamit Nobel, Troisdorf (TNF), or 1 part by weight of 2,5-bis-(4-diethyl-aminophenyl)-oxadiazole-1,3,4 and 1 part by weight of a copolymer of styrene and maleic anhydride, for example Lytron 820 of Monsanto Corp., USA (To), or 1 part by weight of 2,5-bis-(4-diethylaminophenyl)-oxadiazole-1,3,4 and 1 part by weight of the mentioned polyester resin Dynapol L 206 (TD) are applied by whirl-coating as a 20% solution in tetrahydrofurane, in part with the addition of the indicated amount of sensitizer with regard to solids content, and thereafter the solution is dried for 5 minutes at 120° C.

For comparison of the photosensitivity, identical top layers are produced analogously (zero layers) on aluminum foil, and these show that according to the invention increases in photosensitivity which are at times more than a factor of 100 can be achieved.

In order to measure the photosensitivity, the particular photoconductor layer is charged to a positive or negative potential, for which it is passed three times through a charging instrument, for example Kalle type AG 56, setting 7.5 kV. The particular layer is then exposed to an XBO xenon lamp of Messrs. Osram. The light intensity in the plane of measurement is approx. 270 $\mu uW/cm^2$ (437 $\mu uW.cm^{-2}$ in the case of examples numbers 34 to 37). The charge level and the photo-induced light decay curve of the photoconductor layer are measured by means of a 610 B electrometer of Messrs. Keithley Instruments, USA, through a probe in accordance with the method described by Arneth and Lorenz in Reprographie 3, 199 (1963).

The photoconductor layer is characterised by the charge level (V) and by the time (T ½) after which half the charge (V/2) is reached.

Additionally, the sensitivity factor f is determined by means of a Dyn Test-90 instrument of Messrs. ECE, Giessen, for measuring the sensitivity. This factor is calculated from the formula $$f = \frac{U_o}{U_h + \Delta U_D}$$

with $U_o$ as the initial potential, $U_h$ as the potential after 2 seconds' exposure and $\Delta U_D$ as the dark decay after 2 seconds.

This factor indicates by how much the initial potential $U_o$ at the layer is greater than the potential $U_h$ achievable after 2 seconds' exposure with a tungsten lamp, whilst eliminating the dark discharge ($\Delta U_D$).

The abbreviations used for the sensitizers employed denote the following:

| | |
|---|---|
| RhB | Rhodamine B extra |
| BG | Brilliant Green |
| DNB | 2,4-dinitrobenzoic acid |

Table:

| Serial No. | Dyestuff of formula No. | Vapor Deposition Duration/Temperature (min) (° C) | Top layer | Sensitizer (%) | T ½ (msec) | Photosensitivity Charge V | f |
|---|---|---|---|---|---|---|---|
| θ | | | To | — | —2,100 | −420 | 1.0 |
| 0 | | | TNF | — | 11,000 | +500 | 1.0 |
| 1 | I | 1 /340 | TNF | — | 230 | +650 | |
| 2 | I | 1 /340 | TNF | 0.3 RhB | 220 | +1,300 | |
| 3 | I | 1 /340 | To | — | 60 | −850 | |
| 4 | I | 1 /340 | To | 0.3 RhB | 24 | −990 | 2.7 |
| 5 | I | 4 /340 | To | 0.05 BG | 37 | −1,050 | 3.0 |
| 6 | II | 1.5/320 | To | — | 26 | −880 | |
| 7 | II | 2.5/320 | To | 0.3 RhB | 40 | −1,040 | 2.3 |
| 8 | II | 1.5/320 | To | 0.05 BG | 32 | −830 | 3.4 |
| 9 | II | 2.5/320 | To | — | 32 | −405 | 1.8 |
| 10 | II | 2.5/320 | To | — | 27 | −460 | 2.0 |
| 11 | II | 2.5/320 | To | — | 21 | −510 | 2.5 |
| 12 | II | 2.5/320 | To | — | 27 | −480 | 2.9 |
| 13 | III | 2 /270 | TD | — | 60 | −880 | |
| 14 | IV | 4 /270 | TD | 0.35 DNB | 43 | −780 | |
| 15 | V | 2 /160 | To | — | 225 | −780 | |
| 16 | VI | 2 /180 | To | 13 | 108 | −810 | |
| 17 | VII | 3.5/250 | To | — | 95 | −530 | |
| 18 | VIII | 2.5/250 | To | — | 165 | −470 | |
| 19 | IX | 4 /300 | To | — | 53 | −870 | |
| 20 | X | 1 /240 | To | — | 102 | −800 | |
| 21 | X | 1 /240 | To | 0.3 RhB | 48 | −440 | 1.5 |
| 22 | X | 1 /240 | To | 0.05 BG | 55 | −500 | 1.2 |
| 23 | XI | 1.5/250 | To | 0.3 RhB | 25 | −540 | 1.6 |
| 24 | XI | 1.5/250 | To | — | 80 | −750 | |
| 25 | XII | 3 /250 | To | — | 118 | −730 | |
| 26 | XIII | 1 /200 | To | — | 470 | −580 | |
| 27 | XIV | 1.5/270 | To | — | 86 | −580 | |
| 28 | XV | 2.5/260 | To | — | 345 | −700 | |
| 29 | XVI | 3.5/300 | To | — | 270 | −670 | |
| 30 | XVI | 3.5/300 | TNF | — | 370 | +520 | |
| 31 | XVII | 2.5/300 | TNF | — | 325 | +650 | |
| 32 | XIX | 3 /260 | To | 0.3 RhB | 35 | −520 | 1.4 |
| 33 | XX | 1.5/170 | To | 0.3 RhB | 40 | −520 | 1.6 |
| 34 | XXII | 2.0/240 | To | 0.3 RhB | 83 | −520 | |
| 35 | XXIII | 1.0/260 | To | — | 32 | −475 | |
| 36 | XXIV | 4.0/200 | To | 0.3 RhB | 78 | −425 | |
| 37 | XXVI | 2 /340 | To | 0.3 RhB | 72 | −440 | |

It will be obvious to those skilled in the art that many modifications may be made within the scope of the present invention without departing from the spirit thereof, and the invention includes all such modifications.

what is claimed is:

1. An electrophotographic recording material comprising an electroconductive support material with a photoconductive double layer of organic materials composed of a homogeneous, uniform, opaque, charge carrier producing layer of tightly packed dyestuff molecules, prepared by high vacuum evaporation of the dyestuff, and a transparent top layer of insulating materials with at least one charge transporting compound, in which the organic dyestuff layer is composed of a compound of the general formula $$R_1—CH=N(—A—N=CH)_n—R_2 \text{ or}$$
$$R_1—N=CH—A—CH=N—R_2$$

in which $R_1$ and $R_2$ are identical or different and stand for an optionally substituted phenyl, styryl, crabazyl, anthryl, pyrenyl of fluorenyl group, n is 0 or 1, and A is a optionally substituted aromatic and/or heterocyclic ring system selected from the group consisting of benzene, diphenyl, naphthalene, pyrene, perylene, diphenylether, diphenylamine, benzophenone, oxazole, imidazole, pyrazole, thiazole, oxadiazole, bisphenyl-oxadiazole, benz-bis-thiazole, carbazole and xanthene groups, and in which the transparent top layer is composed of a mixture of a charge transporting oxadiazole compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

2. An electrophotographic recording material comprising an electroconductive support material with a photoconductive double layer of organic materials composed of a homogeneous, uniform, opaque, charge carrier producing layer of tightly packed dyestuff molecules, prepared by high vacuum evaporation of the dyestuff, and a transparent top layer of insulating materials with at least one charge transporting compound, in which the organic dyestuff layer is composed of a compound of the general formula $$R_1—CH=N(—A—N=CH)_n—R_2 \text{ or}$$
$$R_1—N=CH—A—CH=N—R_2$$

in which $R_1$ and $R_2$ are identical or different and stand for an optionally substituted phenyl, styryl, carbazyl, anthryl, pyrenyl or fluorenyl group, n is 0 or 1, and A is an optionally substituted aromatic and/or heterocyclic ring system selected from the group consisting of benzene, diphenyl, naphthalene, pyrene, perylene, diphenylether, diphenylamine, benzophenone, oxazole, imidazole, pyrazole, thiazole, oxadiazole, bis-phenyloxadiazole, benz-bis-thiazole, carbazole and xanthene groups, and in which a transparent top layer is composed of a mixture of a charge transporting 2,5-bis-(4-diethylaminophenyl)-oxadiazole-1,3,4 compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

3. An electrophotographic recording material comprising an electroconductive support material with a photoconductive double layer of organic materials composed of a homogeneous uniform opaque charge carrier producing layer of tightly packed bis-(3-pyrenyl-amino)-terephthylidene dyestuff molecules, prepared by high vacuum evaporation of the dyestuff, and a transparent top layer of insulating materials with at least one charge transporting compound, said transparent top layer being composed of a mixture of charge transporting, heterocyclic compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

4. An electrophotographic recording material comprising an electroconductive support material with a photoconductive double layer of organic materials composed of a homogeneous uniform opaque charge carrier producing layer of tightly packed bis-(p-dimethylamino-benzylidene)-4,4'-diamino-diphenylether dyestuff molecules, prepared by high vacuum evaporation of the dyestuff, and a transparent top layer of insulating materials with at least one charge transporting compound, said transparent top layer being composed of a mixture of a charge transporting, heterocyclic compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

5. An electrophotographic recording material comprising an electroconductive support material with a photoconductive double layer of organic materials composed of a homogeneous uniform opaque charge carrier producing layer of tightly packed bis-(p-nitrobenzylidene-p-aminophenyl)-2,5-oxadiazole-1,3,4 dyestuff molecules, prepared by high vacuum evaporation of the dyestuff, and a transparent top layer of insulating materials with at least one charge transporting compound, said transparent top layer being composed of a mixture of a charge transporting, heterocyclic compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

6. An electrophotographic recording material comprising an electroconductive support material with a photoconductive double layer of organic materials composed of a homogeneous uniform opaque charge carrier producing layer of tightly packed bis-(1-anthrylamino)-terephthylidene dyestuff molecules, prepared by high vacuum evaporation of the dyestuff, and a transparent top layer of insulating materials with at least one charge transporting compound, said transparent top layer being composed of a mixture of a charge transporting, heterocyclic compound having an extended $\pi$-electron system, which recording material is useful in an electrophotographic copying process with negative charging of the top layer, if an electron-donating compound is used, and is useful in an electrophotographic copying process with positive charging of the top layer, if the top layer contains an electron-accepting compound.

* * * * *